US007084561B2

(12) United States Patent
Lee et al.

(10) Patent No.: US 7,084,561 B2
(45) Date of Patent: Aug. 1, 2006

(54) PANEL FOR FLAT TYPE COLOR CATHODE RAY TUBE

(75) Inventors: Tae Hoon Lee, Gyeongsangbook-do (KR); Yoon San Park, Guni-si (KR)

(73) Assignee: LG.Philips Displays Korea Co., Ltd., Gyeongsangbuk-Do (KR)

( * ) Notice: Subject to any disclaimer, the term of this patent is extended or adjusted under 35 U.S.C. 154(b) by 273 days.

(21) Appl. No.: 10/700,528

(22) Filed: Nov. 5, 2003

(65) Prior Publication Data

US 2004/0095057 A1 May 20, 2004

(30) Foreign Application Priority Data

Nov. 20, 2002 (KR) ..... 10-2002-0072188
Nov. 26, 2002 (KR) ..... 10-2002-0073866

(51) Int. Cl.
*H01J 29/86* (2006.01)

(52) U.S. Cl. ..... 313/477 R; 220/2.1 A; 220/2.1 R; 220/2.3 A

(58) Field of Classification Search ..... 313/461, 313/477 R; 220/2.1 A, 2.1 R
See application file for complete search history.

(56) References Cited

U.S. PATENT DOCUMENTS 6,066,914 A 5/2000 Shimizu et al.
6,160,344 A 12/2000 Cho et al.
6,232,712 B1 5/2001 Pyun et al.
6,268,693 B1 * 7/2001 Miwa et al. ..... 313/479
6,441,566 B1 8/2002 Shimizu et al.
6,465,945 B1 10/2002 Tsuchida et al.
2003/0117060 A1 * 6/2003 Kim et al. ..... 313/477 R
2004/0000860 A1 * 1/2004 Jung ..... 313/477 R
2004/0239232 A1 * 12/2004 Baek et al. ..... 313/477 R

FOREIGN PATENT DOCUMENTS

CN 1319872 10/2001

* cited by examiner

*Primary Examiner*—Nimeshkumar D. Patel
*Assistant Examiner*—Matt Hodges
(74) *Attorney, Agent, or Firm*—McKenna Long & Aldridge LLP

(57) ABSTRACT

A cathode ray tube with a panel includes an inside surface having a designated curvature; a central portion having a transmission rate of 45–75%; and an outside surface being substantially flat with a flatness ratio (F) satisfying a mathematical formula of $$F = \frac{Ro}{Sd \times 1.767},$$

where Ro denotes a diagonal curvature radius of the outside surface, Sd denotes a diagonal length of an effective surface of the panel, and the flatness ratio (F) of the outside surface is greater than 17. The dimensions of the panel are such that the thickness at the central portion of the panel (CFT), the thickness of a vertical axis end (Tv), and the thickness of a diagonal end (Td) satisfy conditions of 1.4<Td/CFT<2.2, and 0.85<Tv/Td<1.0.

22 Claims, 8 Drawing Sheets

PANEL FOR FLAT TYPE COLOR CATHODE RAY TUBE

This application claims the benefit of Korean Patent Application No. 2002-72188, filed on Nov. 20, 2002 and Korean Patent Application No. 2002-73866, filed on Nov. 26, 2002, which are hereby incorporated by reference for all purposes as if fully set forth herein.

BACKGROUND OF THE INVENTION

1. Field of the Invention

The present invention relates to a cathode ray tube, and more particularly, to a cathode ray tube with uniform brightness and much improved contrast for relieving visual discomfort of viewers.

2. Description of the Related Art

FIG. 1 is a diagram explaining the structure of an already-known color cathode ray tube.

Referring to FIG. 1, the conventional color cathode ray tube includes a front side glass panel 3, and a rear side glass funnel 2 welded to the panel 3. The panel 3 and the funnel 2 are welded to each other in a manner that their interior is under a vacuum, thereby forming a vacuum tube.

A fluorescent screen 7 is formed on the inside surface of the panel 3, and an electron gun 6 is mounted on a neck portion of the funnel 2 opposite to the fluorescent screen 7.

A shadow mask 8 with a color selecting function is located between the fluorescent screen 7 and the electron gun 6, maintaining a predetermined distance from the fluorescent screen 7. The shadow mask 8 is supported by a mask frame 9. The mask frame 9 is elastically supported by a mask spring 1 and connected to a stud pin 4 to be supported to the panel 3.

The mask frame 9 is joined with an inner shield 11 made of a magnetic material to reduce the movement of an electron beam 5 due to an external magnetic field during operation of the cathode ray tube. A deflection yoke 13 for deflecting the electron beam 5 emitted from the electron gun 6 is mounted into a neck portion of the funnel 2. Also, a reinforcing band 10 is included in order to reinforce the front surface glass under the influence of the vacuum state inside the tube.

In operation, the electron beam 5 emitted from the electron gun 6 is deflected vertically and horizontally by the deflection yoke 13, and the deflected electron beam 5 passes through a beam passing hole on the shadow mask 8 and strikes the fluorescent screen 7 on the front, consequently displaying a desired color image. Particularly, the inner shield 11 shields the magnetic field from the rear side of the cathode ray tube.

Whether the panel 3 is explosion proof or has substantially good visibility is heavily dependent on how its inside and outside surface curvatures are formed. In particular, the inside surface curvature has a great impact on the sense of flatness of the screen and the presence of distortion in the image. Further, the transmission rate of the panel 3 plays a very important role for realizing a high quality cathode ray tube because uniform brightness and high contrast are entirely dependent upon the transmission rate.

Generally, the inside surface curvature of the panel can be expressed by a ratio (or wedge) of the thickness of a diagonal end to the thickness at a central portion of the panel (CFT). Compared with a cathode ray tube with a curved outside surface, of which wedge is about 1.30, a cathode ray tube having a substantially flat panel has a wedge greater than 2.2, thus the peripheral portion of this panel, particularly the diagonal end, is extremely thick.

FIG. 2 is a diagram explaining the structure of a panel for the known cathode ray tube.

As illustrated in FIG. 2, the panel 3, which is approximately rectangular in shape, is formed of an effective surface portion 14 where the fluorescent screen is formed, a long side portion 15, a short side portion 16, and a diagonal portion 17. A skirt portion 18 in a curved shape is formed extending away from the edge of the effective surface portion 14 to a rear side of the tube axis direction.

FIG. 3 is a diagram explaining the structure of the effective surface portion of the panel in the known cathode ray tube. Referring to FIG. 3, the substantially flat panel, when the outside effective surface 14 is seen with the naked eye, has an outside surface curvature radius that appears almost flat while the inside surface of the panel has a recognizable curvature. More specifically, the inside surface curvature can be divided into three components: a vertical curvature radius (Rv) in the vertical direction (V), a horizontal curvature radius (Rh) in the horizontal direction (H), and a diagonal curvature radius (Rd) in the diagonal direction. In general, these curvature radii are in a relation of Rd>Rh>Rv. That is, the diagonal curvature radius (Rd) is greater than the horizontal curvature radius (Rh), and the horizontal curvature radius (Rh) is greater than the vertical curvature radius (Rv).

Typically, the wedge, i.e. the ratio of the thickness of a diagonal end (Td) to the thickness at a central portion of the panel (CFT) is in a range of 2.2 to 2.3. As the wedge (Td/CFT) gets closer to 1, the sense of flatness of the screen and manufacturing advantages of the panel are improved. However, it was also discovered that under these conditions the shadow mask at a predetermined distance from the inside surface of the panel 3 could be easily deformed by an external shock.

To obviate such problem, the wedge (Td/CFT) is usually set higher than 2.2.

However, increasing the wedge means decreasing the thickness at the central portion of the panel 3 (CFT) in contrast to the thickness of the diagonal end (Td). In doing so, the panel 3 often breaks down during a thermal process out of the manufacturing procedure, and the flatness of the image is also deteriorated as the inside surface curvature radius of the panel is decreased due to the high wedge.

Moreover, if the thickness of the peripheral portion of the panel 3 is increased, its transmission rate is noticeably reduced as well, extremely lowering the uniformity of brightness.

For instance, suppose that the wedge of the panel used in a 27-inch cathode ray tube is about 2.2. Then the transmission rate at the central portion of the panel is 51% while the transmission rate at the peripheral portion of the panel is about 25%, which is less than ½ (0.5) of the transmission rate at the central portion of the panel. This resultantly breaks down the uniformity of brightness, making the cathode ray tube totally useless. Therefore, the ratio (%) of transmission rates should be at least 59% or higher so as to allow the cathode ray tube to carry out its basic performance.

FIG. 4 is a diagram explaining the outside surface curvature of the panel, which is substantially flat.

As shown in FIG. 4, P(x, y, z) indicates a point on the substantially flat outside surface of the panel. The outside surface curvature radius of the panel can be expressed by the following mathematical formula I.

[Mathematical Formula I]

$$\text{Curvature radius} = \frac{\left(\sqrt{x^2+y^2}\right)^2 + z^2}{2 \times z}$$

Given that the origin, coincident with the optical axis of the outside surface of the panel, is (0,0,0), the vector (x,y,z) indicates a distance from the origin to an arbitrary point on the outside surface, along the x-axis, y-axis, and z-axis.

The outside surface curvature radius of the panel with the substantially flat outside surface in the conventional cathode ray tube is approximately 100,000 mm. A strong point of this type of panel is that since a viewer perceives the panel as flat, the sense of flatness of the screen is secured and the viewer hardly sees distorted images.

On the other hand, when the wedge of the panel whose outside surface is substantially flat becomes high, e.g. greater than 2.0, the thickness of the diagonal end becomes extremely large and this affects the contrast of brightness of images.

The following mathematical formula II represents the transmission rate of the panel.

[Mathematical Formula II]

$$\text{Transmission rate } (TM) = (1-Re)^2 \times e^{-kt} \times 100(\%)$$

W\where Re denotes the reflectivity of glass; k denotes the absorbency index; and t denotes the thickness of glass.

The above formula shows that as the wedge of the panel is increased, the ratio of the thickness of a diagonal end to the thickness at a central portion of the panel becomes greater, and the difference between the transmission rate at the central portion of the panel and at the peripheral portion of the panel becomes larger. As a result, the brightness at the central portion and the peripheral portion will be much different from each other and cause visual discomfort to the viewer.

As an attempt to solve this problem, some used a panel having at least 85% of transmission rate at the central portion, hoping to secure the uniformity of brightness without deteriorating the peripheral transmission rate.

Table 1 shows contrast ratios (%) of the peripheral portion to the central portion and transmission rates (%) of the peripheral portion to the central portion, given an illumination with an external light of 200 lux (lx).

TABLE 1

| Transmission rate of central portion (%) | Ratio of contrast of peripheral portion to central portion (%) | Ratio of transmission rate of peripheral portion to central portion (%) |
|---|---|---|
| 90 | 14.0 | 98.7 |
| 85 | 14.9 | 93.2 |
| 80 | 16.0 | 87.8 |
| 75 | 17.1 | 82.3 |
| 70 | 18.4 | 76.8 |
| 65 | 19.7 | 71.3 |
| 60 | 21.1 | 65.9 |
| 55 | 22.6 | 60.4 |
| 50 | 24.2 | 54.9 |

In short, as the transmission rate of the central portion is improved, the ratio of the transmission rate of the peripheral portion to the transmission rate of the central portion is also improved but the ratio of the contrast of the peripheral portion to that of the central portion is lowered.

Although it is possible to secure uniformly bright images without reducing the transmission rate at the peripheral portion by using panel having a transmission rate at the central portion of the panel being higher than 85%, this also gives rise to other problems, e.g. excessive brightness or poor contrast characteristics.

Especially when the contrast is bad and the cathode ray tube is operated in a place where the illumination of the external light is greater than 200 lux (lx), it becomes virtually impossible to obviate the visual discomfort problem.

One solution to overcome the above drawback is putting a coating or film on the panel, however, the method was not found very favorable because it required extra processing and cost.

SUMMARY OF THE INVENTION

Accordingly, the present invention is directed to a panel for a flat panel type color cathode ray tube that substantially obviates one or more of the problems due to limitations and disadvantages of the related art.

An advantage of the invention is to solve at least the above problems and/or disadvantages and to provide at least the advantages described hereinafter.

Additional advantages and features of the invention will be set forth in part in the description which follows and in part will become apparent to those having ordinary skill in the art upon examination of the following or may be learned from practice of the invention. The advantages of the invention may be realized and attained as particularly pointed out in the appended claims. To achieve these and other advantages and in accordance with the purpose of the present invention, as embodied and broadly described, a cathode ray tube with a panel includes an inside surface having a designated curvature; a central portion having a transmission rate of 45–75%; and an outside surface being substantially flat with a flatness ratio (F) satisfying a mathematical formula of $$F = \frac{Ro}{Sd \times 1.767},$$

where Ro denotes a diagonal curvature radius of the outside surface, Sd denotes a diagonal length of an effective surface of the panel, and the flatness ratio (F) of the outside surface is greater than 17. The dimensions of the panel are such that the thickness at the central portion of the panel (CFT), the thickness of a vertical axis end (Tv), and the thickness of a diagonal end (Td) satisfy conditions of $1.4<Td/CFT<2.2$, and $0.85<Tv/Td<1.0$.

In another aspect of the present invention, a cathode ray tube with a panel includes: a central portion having a transmission rate of 45–75%; an outside surface being substantially flat with a flatness ratio (F) satisfying a mathematical formula of $$F = \frac{Ro}{Sd \times 1.767},$$

where Ro denotes a diagonal curvature radius of the outside surface, Sd denotes a diagonal length of an effective surface of the panel, and the flatness ratio (F) of the outside surface is greater than 17; and an inside surface having a designated curvature in which the diagonal curvature radius of the inside surface (Rd), the vertical curvature radius of the inside surface (Rv), and the horizontal curvature radius of the inside surface (Rh) satisfy conditions of 1.0<Rh/Rd<1.9, and 0.3<Rv/Rd<0.9.

In another aspect of the present invention, a cathode ray tube with a panel includes: an inside surface having a designated curvature; a central portion with a transmission rate of 45–75%, wherein the ratio of the transmission rate at the peripheral portion of the panel to that of the central portion of the panel is in the range of 50–65%; and an substantially flat outside surface, wherein an arbitrary point, P(x, y, z), on the outside surface of the panel satisfies a condition of $$20{,}000\ \text{mm} \le \frac{\left(\sqrt{x^2+y^2}\right)^2+z^2}{2\times z} \le 70{,}000\ \text{mm}.$$

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF ILLUSTRATED EMBODIMENTS

Reference will now be made in detail to an embodiment of the present invention, an example of which is illustrated in the accompanying drawings.

Table 2 below shows how the vertical height (mm) at the central portion of the panel relative to the vertical height of a diagonal end of the effective surface, and the ratio (%) of the transmission rate of the peripheral portion to the transmission rate at the central portion of the panel change in accordance with the outside surface curvature radius of the panel.

TABLE 2

| Outside surface curvature radius of the panel (mm) | Vertical height at the central portion of the panel from diagonal end of the effective surface (mm) | Ratio of transmission rate at the peripheral portion to transmission rate at the central portion of the panel (%) |
|---|---|---|
| 100,000 | 0.571 | 57.88 |
| 90,000 | 0.635 | 58.05 |
| 80,000 | 0.714 | 58.26 |
| 70,000 | 0.816 | 58.54 |
| 60,000 | 0.952 | 58.91 |
| 50,000 | 1.142 | 59.43 |
| 40,000 | 1.428 | 60.22 |
| 30,000 | 1.904 | 61.56 |
| 20,000 | 2.856 | 64.33 |
| 10,000 | 5.714 | 73.42 |

Table 2 shows that as the outside surface curvature radius of the panel is increased, the vertical height at the central portion of the panel relative to the vertical height of the diagonal end of the effective surface, as well as the ratio of the transmission rate at the peripheral portion to the transmission rate at the central portion of the panel, i.e. peripheral transmission rate of the panel/central transmission rate of the panel, are reduced.

In case of the conventional panel whose outside surface is substantially flat, the outside surface curvature radius of the panel was about 100,000 mm and the vertical height at the central portion of the panel was 0.571 mm, which was enough to improve the sense of flatness. Meanwhile, the wedge of the panel was higher than 2.2, giving rise to a problem that the peripheral portion of the panel, especially the thickness of the diagonal end, got too thick, and as a result, the uniformity of brightness was not maintained.

In addition, the ratio of the transmission rate at the peripheral portion to the transmission rate at the central portion of the panel was 57.88%, which is very large. Again, the brightness at the central portion was much different from the peripheral portion, causing visual discomfort to the viewer.

Figure 1:
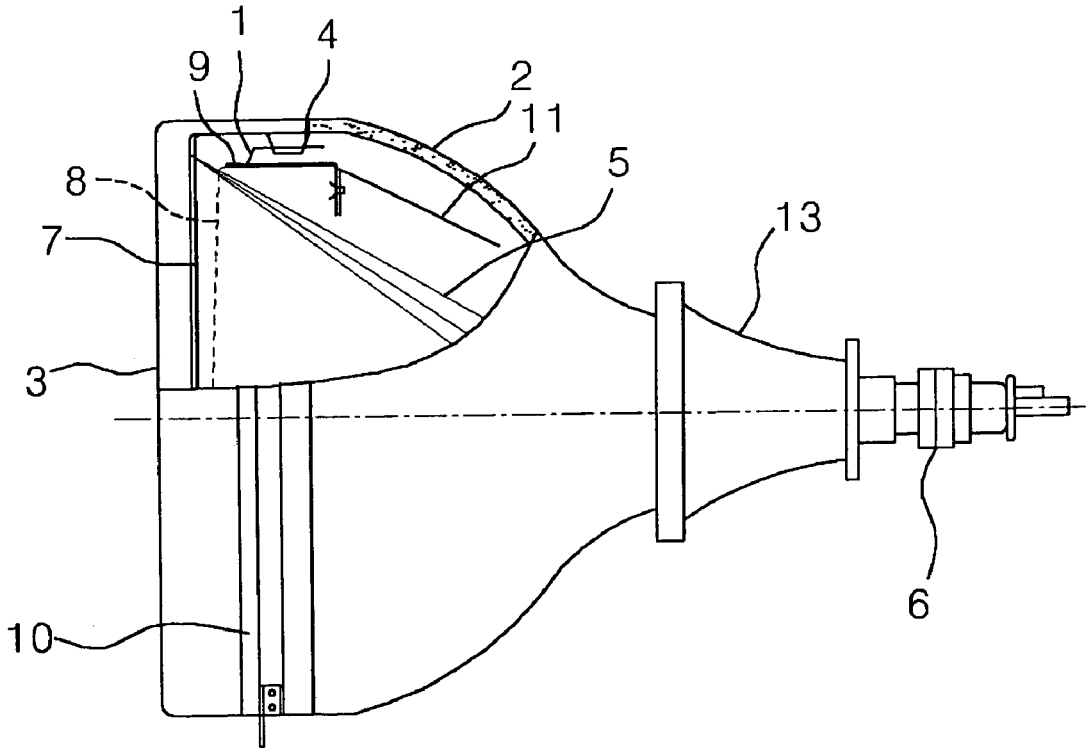
FIG. 1 (Background Art)
FIG. 1 is a diagram explaining a structure of a known color cathode ray tube.
Figure 2:
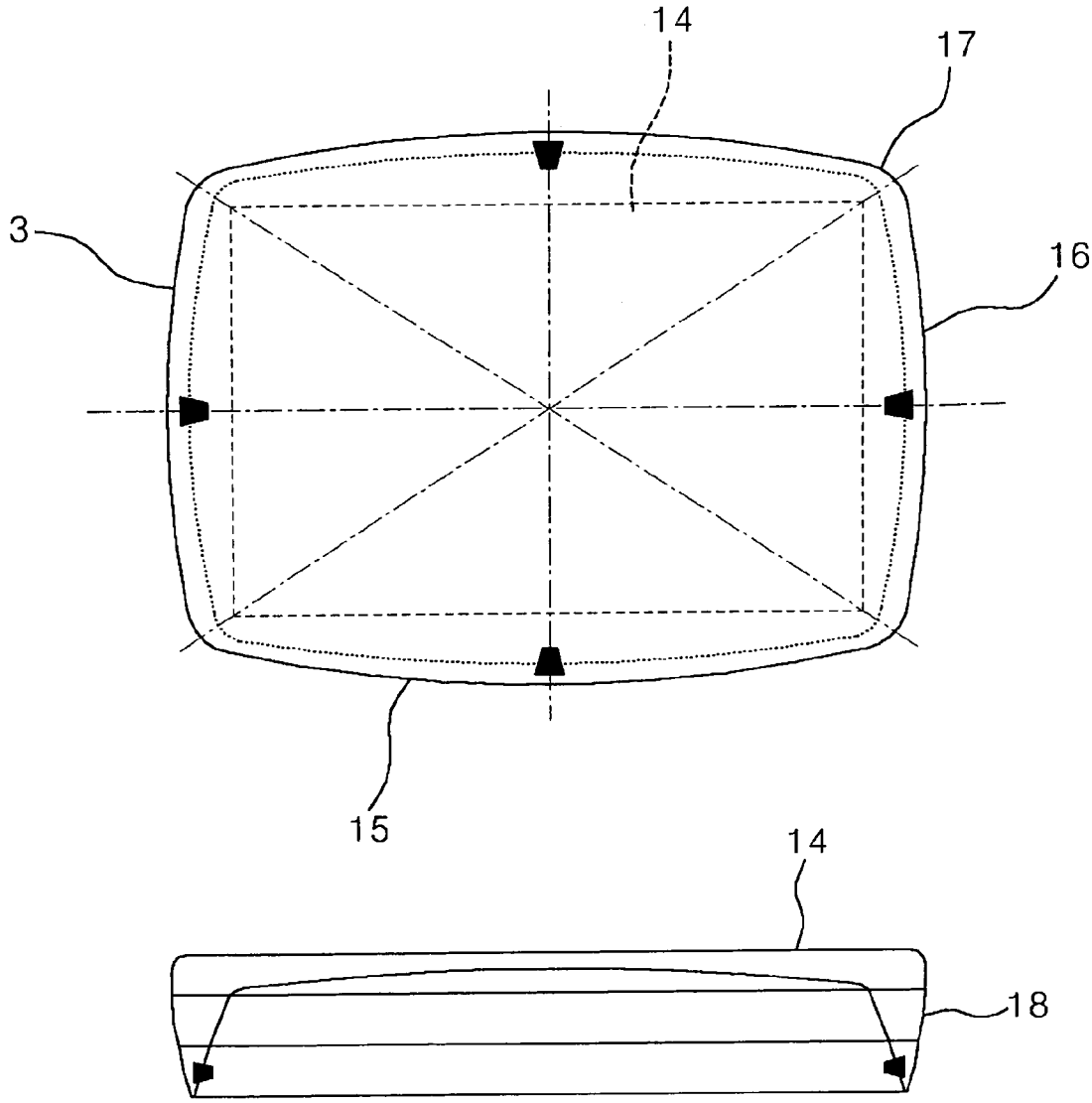
FIG. 2 (Background Art)
FIG. 2 is a diagram explaining a structure of a panel for the known cathode ray tube.
Figure 3:
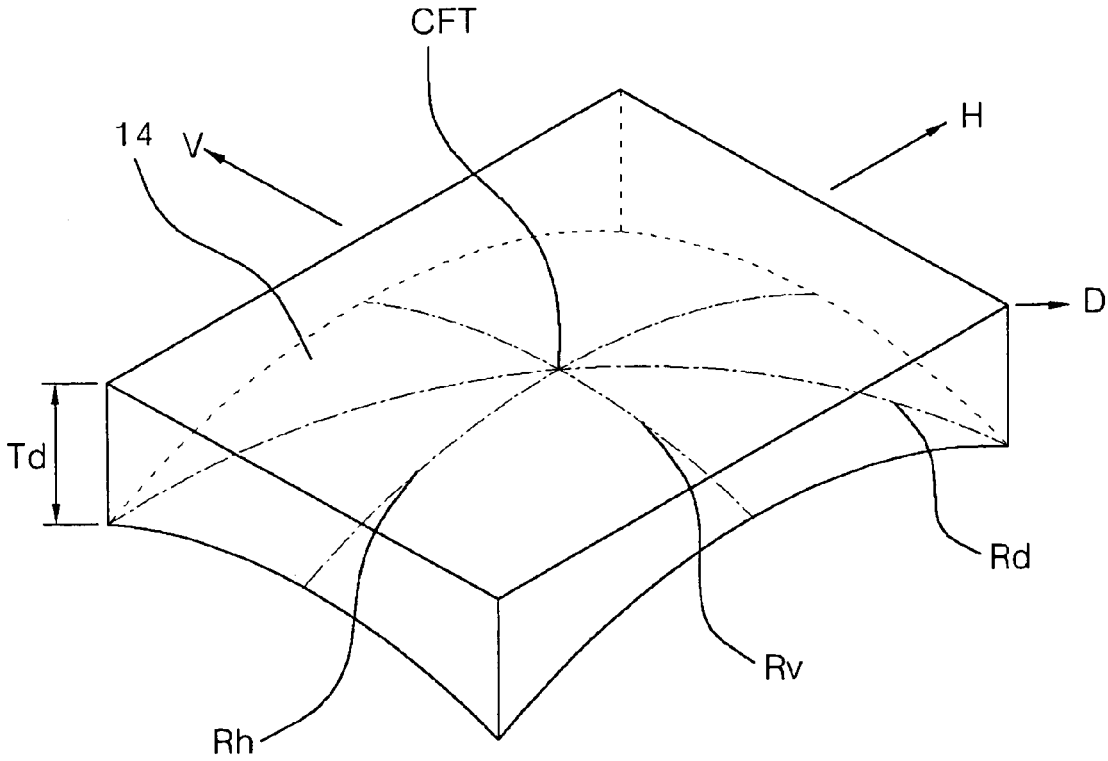
FIG. 3 (Background Art)
FIG. 3 is a diagram explaining a structure of an effective surface portion of the panel for the known cathode ray tube.
Figure 4:
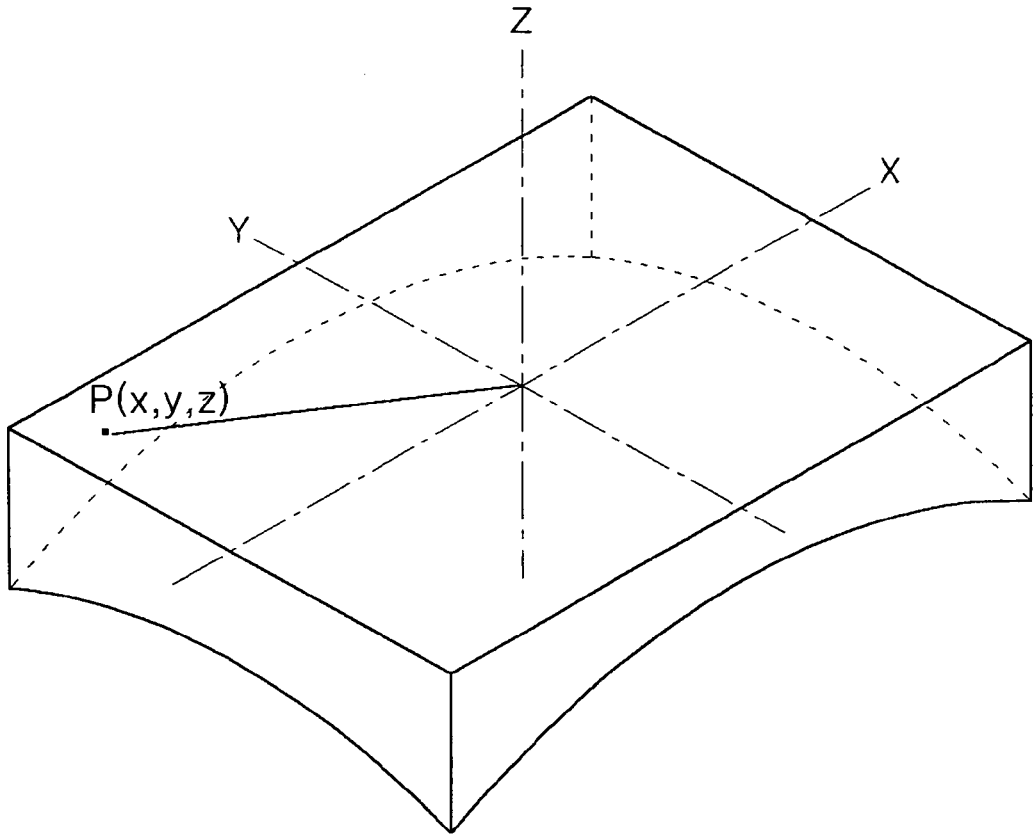
FIG. 4 (Background Art)
FIG. 4 is a diagram explaining an outside surface curvature of a panel of which outside surface is substantially flat for the known cathode ray tube.
Figure 5:
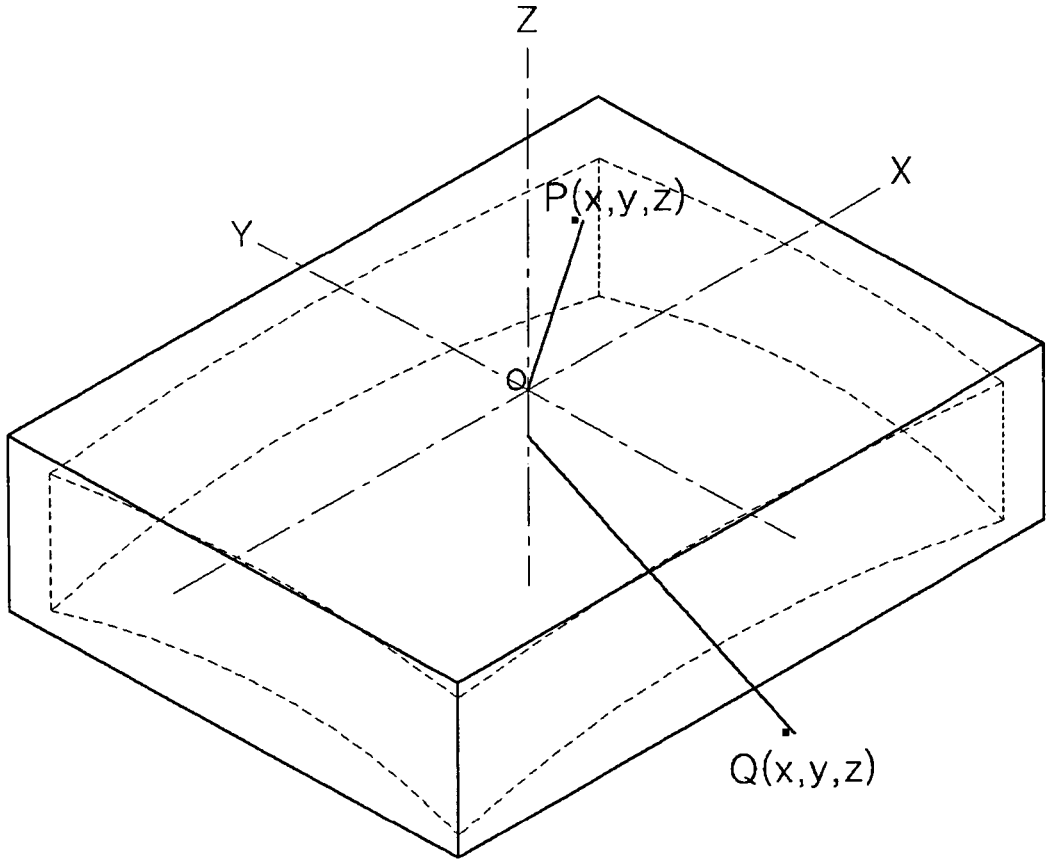
FIG. 5 is a diagram explaining a curvature radius of a panel for a cathode ray tube according to the present invention.

FIG. 5 is a diagram explaining the curvature radius of the panel for the cathode ray tube according to the present invention.

Referring to FIG. 5, the outside surface of the panel is substantially flat and the inside surface of the panel is curved. Given an arbitrary point, P(x, y, z), on the outside surface of the panel, the point satisfies a condition of $$20{,}000\ \text{mm} \le \frac{\left(\sqrt{x^2+y^2}\right)^2+z^2}{2\times z} \le 70{,}000\ \text{mm}.$$

In other words, the ratio of the transmission rate at the peripheral portion to the transmission rate at the central portion of the panel is increased by 0.66–6.45% when the arbitrary point, P(x, y, z), satisfies a condition of $$20{,}000\ \text{mm} \le \frac{\left(\sqrt{x^2+y^2}\right)^2+z^2}{2\times z} \le 70{,}000\ \text{mm}.$$

Moreover, when the outside surface curvature radius of the panel is 20,000 mm, the vertical height at the central portion of the panel from the diagonal end of the effective surface of the panel becomes 2.856 mm, giving a satisfactory sense of flatness to viewers.

However, if $$\frac{\left(\sqrt{x^2+y^2}\right)^2+z^2}{2\times z}$$

is smaller than 20,000 mm, the vertical height at the central portion of the panel from the diagonal end of the effective surface of the panel becomes greater than 2.856 mm, which destroys the sense of flatness of the screen and distorts images on the screen.

On the other hand, if $$\frac{\left(\sqrt{x^2+y^2}\right)^2+z^2}{2\times z}$$

is greater than 70,000 mm, the ratio of the transmission rate at the peripheral portion to the transmission rate at the central portion of the panel becomes less than 58.54%. In consequence, the brightness at the central portion of the screen is much different from the brightness at the peripheral portion and visual discomfort to the viewer occurs.

More preferably, as for the cathode ray tube with the panel whose outside surface is substantially flat and the inside surface is curved, an arbitrary point, P(x, y, z), on the outside surface of the panel satisfies a condition of $$20{,}000\ \text{mm} \le \frac{\left(\sqrt{x^2+y^2}\right)^2+z^2}{2\times z} \le 50{,}000\ \text{mm}.$$

In other words, the ratio of the transmission rate at the peripheral portion to the transmission rate at the centralportion of the panel is increased by 1.55–6.45% when the arbitrary point, P(x, y, z), satisfies a condition of $$20{,}000\ \text{mm} \le \frac{\left(\sqrt{x^2+y^2}\right)^2+z^2}{2\times z} \le 50{,}000\ \text{mm}.$$

Also, the contrast between the central portion and the peripheral portion of the screen caused by the thick diagonal end may be solved by making the wedge of the panel in the range of 1.4–2.2. That is, visual discomfort of the viewer due to the contrast between the central portion and the peripheral portion of the screen that is caused by the difference in thickness at the central portion of the panel and the diagonal end does not occur in the conventional panel whose outside surface is substantially flat.

Once the above condition is met, the outside surface curvature radius of the panel can be just 20,000 mm because the vertical height at the central portion of the panel from the diagonal end of the effective surface of the panel in this case becomes 2.856 mm, maintaining the sense of flatness.

As mentioned earlier, if $$\frac{\left(\sqrt{x^2+y^2}\right)^2+z^2}{2\times z}$$

is smaller than 20,000 mm, the vertical height at the central portion of the panel from the diagonal end of the effective surface of the panel becomes greater than 2.856 mm, and this destroys the sense of flatness of the screen and distorts images on the screen.

On the other hand, if $$\frac{\left(\sqrt{x^2+y^2}\right)^2+z^2}{2\times z}$$

is greater than 50,000 mm, the ratio of the transmission rate at the peripheral portion to the transmission rate at the central portion of the panel becomes less than 58.91%. In consequence, the brightness at the central portion of the screen is much different from the brightness at the peripheral portion and visual discomfort to the viewer occurs.

Therefore, the ratio of the transmission rate at the peripheral portion to the transmission rate at the central portion of the panel should be at least 58.91% or more to be able to relieve visual discomfort. In short, if a panel, with a designated inside curvature, has an outside curvature wherein an arbitrary point, P(x, y, z), on the outside surface satisfies the condition of $$20{,}000\ \text{mm} \le \frac{\left(\sqrt{x^2+y^2}\right)^2+z^2}{2\times z} \le 50{,}000\ \text{mm},$$

there is no need to use a panel whose transmission rate at the central portion is greater than 85% to adjust the ratio of the peripheral transmission rate to the central transmission rate and there is no need to put a coating over the panel or attach a film to the panel to improve the contrast of the screen. In other words, visual discomfort due to the contrast can be resolved using a panel whose transmission rate at the central portion is in the range of 45–75%. In this way, the contrast of the screen can be greatly improved as well.

More preferably, the arbitrary point, P(x, y, z), on the outside surface of the panel satisfies a condition of $$20{,}000\ \text{mm} \le \frac{\left(\sqrt{x^2+y^2}\right)^2+z^2}{2\times z} \le 25{,}000\,\text{mm}$$

whereby the ratio of the transmission rate at the peripheral portion to the transmission rate at the central portion of the panel can be maintained at approximately 63–64.33%, and the thickness of the diagonal end of the panel does not get extremely thick.

Also, an arbitrary point, Q(x, y, z), on the inside surface of the panel preferably satisfies a condition of $$3{,}500\ \text{mm} \le \frac{\left(\sqrt{x^2+y^2}\right)^2+z^2}{2\times z} \le 5{,}000\,\text{mm}.$$

If, for the inside surface, $$\frac{\left(\sqrt{x^2+y^2}\right)^2+z^2}{2\times z}$$

is greater than 5000 mm, the slot space of the shadow mask increases and resolution is deteriorated. On the other hand, if $$\frac{\left(\sqrt{x^2+y^2}\right)^2+z^2}{2\times z}$$

is smaller than 3500 mm, the diagonal end of the panel gets too thick and the contrast between the central portion and the peripheral portion of the screen becomes severe.

Figure 6:
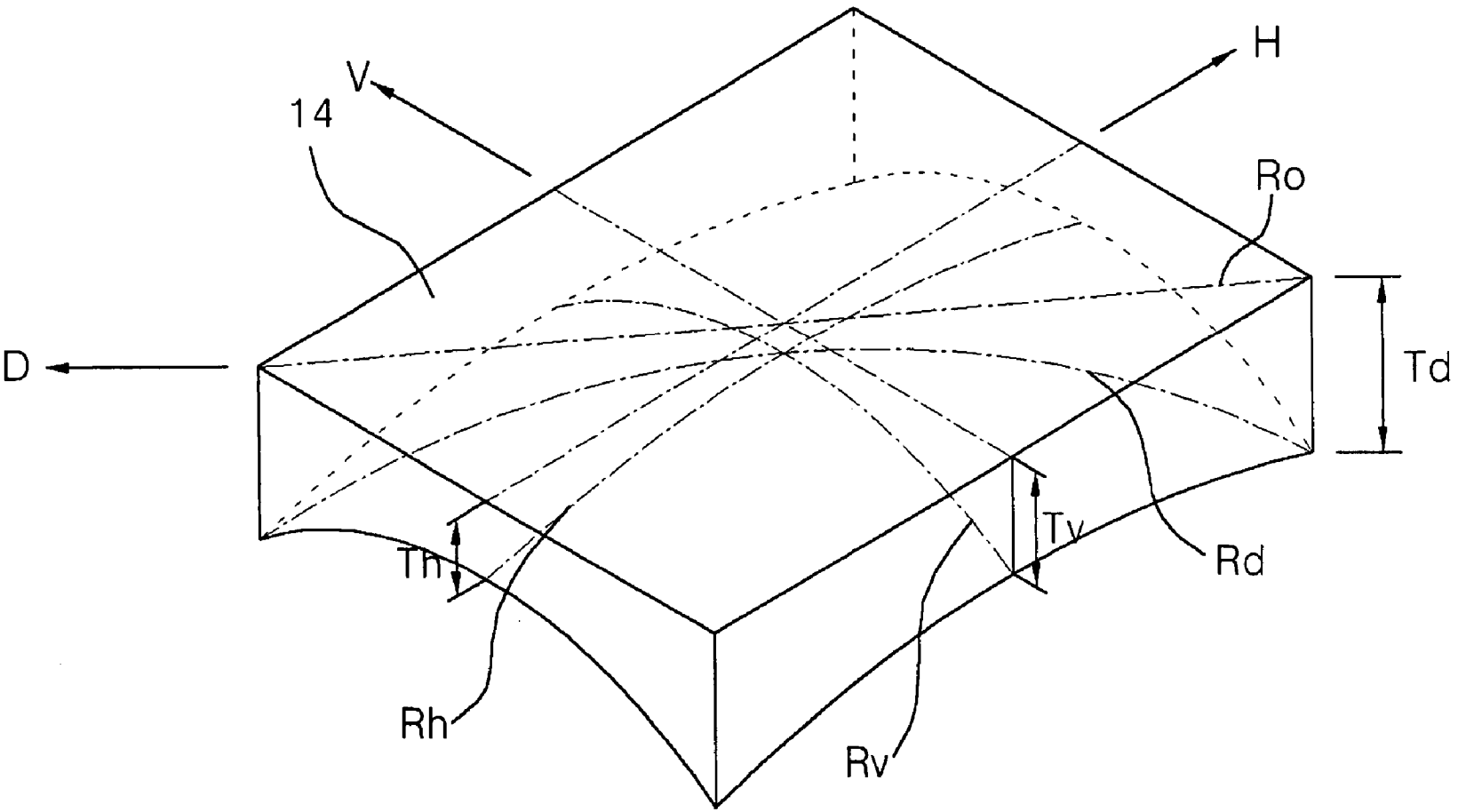
FIG. 6 is a diagram explaining an effective surface portion of the panel for the cathode ray tube according to the present invention.
Figure 7:
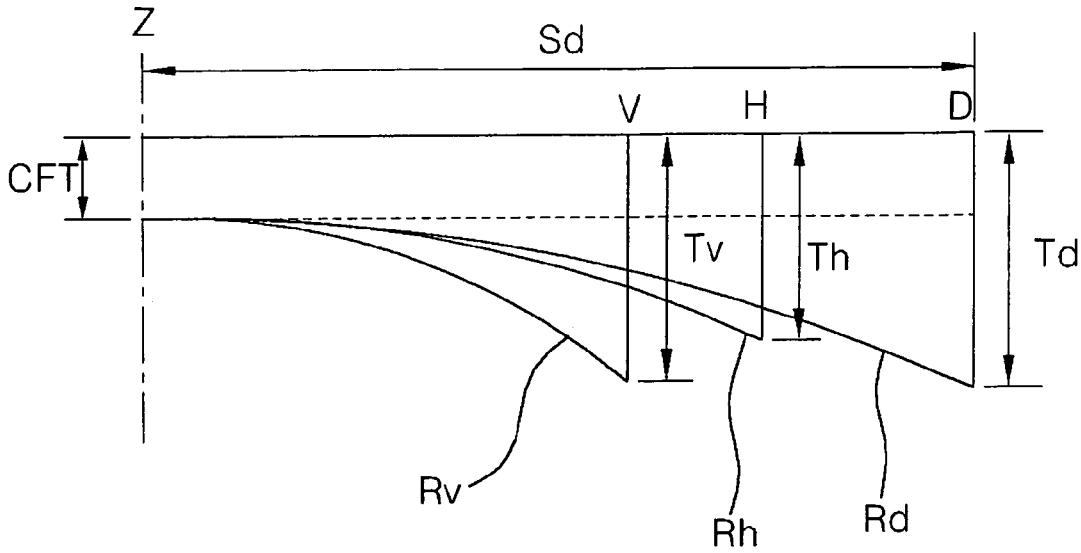
FIG. 7 is a diagram explaining the effective surface portion of the panel for the cathode ray tube according to the present invention.

FIG. 6 and FIG. 7 are diagrams explaining the effective surface portion of the panel for the cathode ray tube according to the present invention.

To obtain high contrast, the transmission rate at the central portion of the effective portion of the panel may be lowered from the conventional level, i.e. 80%, to 45–75% while maintaining the brightness of displayed images, and to prevent the brightness at the peripheral portion from being too dark after lowering the transmission rate at the central portion of the panel, the ratio of the transmission rate at the peripheral portion to the transmission rate at the central portion should be at least 60% or more if the wedge is maintained below 2.0.

When the wedge is below 2.0, the shadow mask loses its mechanical strength and shock resistance of the panel is somewhat lowered. To preserve the strength of the shadow mask and panel at a low wedge, it is necessary to get an optimized inside surface curvature radius. In general, the inside surface curvature radii of the panel satisfy the following condition: Rd>Rh>Rv. The problem with such condition is that it only sets a limitation on the strength of the shadow mask. For this reason, the present invention restructures the inside of the panel, such that, Rh>Rd>Rv. Moreover, the panel of the present invention provides an outside surface curvature radius to make the viewer believe that the screen is flat similar to the conventional one. In general, as the outside surface curvature radius of the panel increases, the sense of flatness the viewer perceives is improved as well. However, the viewer will soon feel no difference when the outside surface curvature radius of the panel reaches a certain level where the sense of flatness is saturated. On the other hand, in case where the outside surface curvature radius is increased, the panel is left with more tension. Hence, there may have to be a certain limitation on the flatness of the panel to keep tension at a minimum.

Suppose that outside surface flatness ratio of the effective surface of the panel is F, outside surface diagonal curvature radius of the panel is Ro, and diagonal length of the effective surface of the panel is Sd. Then, the outside surface flatness ratio is $$F = \frac{Ro}{Sd \times 1.767}.$$

Preferably, the flatness ratio (F) is greater than 17 in consideration of the flatness and the tension of the panel.

For instance, the outside surface diagonal curvature radius (Ro) of the panel for a 32-in cathode ray tube whose flatness ratio (F) is 17 can be obtained from the above formula, i.e. Sd×1.767×17=680 mm×1.767×17=20426 mm.

In addition, the central thickness of the effective surface of the panel (CFT), the thickness of the diagonal end of the panel (Td), the thickness of the horizontal axis end of the panel (Th), and the thickness of the vertical axis end of the panel (Tv) are in a specific relation to one another. For example, the wedge (Td/CFT) should be greater than 1.4 and smaller than 2.2 so as to reinforce the strength of the shadow mask.

If the wedge (Td/CFT) is smaller than 1.4, the shadow mask is not strong enough, and if it is greater than 2.2, the transmission rate at the peripheral portion of the panel becomes too low to maintain the uniform brightness. Therefore, the ratio of the thickness of the diagonal end of the panel (Td) to the central thickness of the panel (CFT) should satisfy a condition: 1.4<Td/CFT<2.2. For the sake of maintaining the uniformity of brightness, the ratio preferably satisfies a condition of 1.4<Td/CFT<2.0.

Further, the ratio of the thickness of the vertical axis end of the panel (Tv) to the thickness of the diagonal end of the panel (Td) is preferably in a condition of 0.85<Tv/Td<1.00, in order to maintain the structural strength of the shadow mask and uniform brightness for the screen.

More preferably, the ratio of the thickness of the vertical axis end of the panel (Tv) to the thickness of the diagonal end of the panel (Td) is preferably satisfies a condition of 0.93<Tv/Td<1.00, resulting in a more uniform brightness for the screen.

Table 3 below illustrates an embodiment having values of the various panel parameters of the cathode ray tube according to the present invention.

TABLE 3

| | Rv | Rh | Rd | Rh/Rd | Rv/Rd |
|---|---|---|---|---|---|
| Embodiment | 1809 mm | 5676 mm | 4616 mm | 1.23 | 0.36 |

As shown in Table 3, the inside surface curvature radii of the effective surface of the panel according to the present invention are such that Rh>Rd>Rv. Following this condition, it is possible to make the shadow mask have a larger diagonal curvature than the conventional one (diagonal curvature radius is smaller than horizontal curvature radius) and at the same time, reinforce the strength of the shadow mask. The diagonal curvature radius of the inside surface of the panel, Rd, satisfies a condition of 2.0R<Rd<4.5R, where 1R=1.767×the diagonal length of the effective surface of the panel. When Rd is smaller than 2.0R, the uniform brightness of the screen and the sense of flatness are reduced, and when the diagonal curvature radius is greater than 4.5R, the structural strengths of the shadow mask and the panel are weakened. The parameter Rh may satisfiy a condition of 3.0R<Rh<6.5R, where 1R=1.767×the diagonal length of the effective surface of the panel.

Similar to above, when Rh is smaller than 3.0R, the uniform brightness of the screen and the sense of flatness are reduced, and when the horizontal curvature radius is greater than 6.5R, the structural strengths of the shadow mask and the panel are weakened. The vertical curvature radius of the inside surface of the panel, Rv, may satisfiy a condition of 1.2R<Rv<3.5R, where 1R=1.767×the diagonal length of the effective surface of the panel.

Again, when Rv is smaller than 1.2R, the uniform brightness of the screen and the sense of flatness decrease, and when the vertical curvature radius is greater than 3.5R, the structural strengths of the shadow mask and the panel are weakened. The ratio of Rd to Rh is 1.23, and the ratio of Rd to Rv is 0.36. Preferably, the ratio of Rh to Rd, i.e. Rh/Rd, may be greater than 1.0 and smaller than 1.9, to maintain the strength of the shadow mask and the panel. When the ratio Rh/Rd is greater than 1.9, the thickness of the horizontal axis end of the panel (Th) becomes so thin that it might be under the influence of much increased tensional stress.

More preferably, the ratio of Rh to Rd (Rh/Rd) is greater than 1.0 and smaller than 1.3 in considerations of the strength of the panel and the uniformity of brightness of the screen.

For the sake of the strength of the panel and the shadow mask, the ratio of the vertical curvature radius (Rv) to the diagonal curvature radius (Rd), i.e. Rv/Rd, is greater than 0.3 and smaller than 0.9.

To be short, Rh, Rd, Rv satisfy the conditions of 1.0<Rh/Rd<1.3 and 0.3<Rv/Rd<0.9.

After making necessary modifications on the structure of curvature radii of the panel and the panel thickness in conformation to the above, several tests were done to discover features of the cathode ray tube and shadow mask. The results thereof are provided in Table 4 below.

TABLE 4

| | Central Transmission | CFT (mm) | Th (mm) | Tv (mm) | Td (mm) | Tv/Td | Wedge (Td/CFT) | Drop strength | Natural Frequency |
|---|---|---|---|---|---|---|---|---|---|
| Embodiment | 51% | 12.5 | 18.2 | 23.5 | 23.8 | 0.99 | 1.90 | 21.0 G | 136 Hz |
| Comparative Example | 80% | 12.5 | 21.0 | 25.2 | 27.6 | 0.91 | 2.21 | 21.5 G | 118 Hz |
| Difference | −29% | 0 | −2.80 | −1.68 | −3.80 | 0.08 | −0.31 | −0.5 G | 18 Hz |
| Effect | | | Thickness has been reduced. | | | Improved | Reduced by 0.31. | Constant | Improved |

As Table 4 shows, the thickness of the diagonal end of the panel (Td) was reduced by 3.8 mm, the thickness of the horizontal axis end of the panel (Th) was reduced by 2.8 mm, and the thickness of the vertical axis end of the panel (Tv) was reduced by 1.68 mm. Meanwhile, the ratio of the thickness of the vertical axis end of the panel (Tv) to the thickness of the diagonal end of the panel (Td) was increased by 0.08, the drop strength of the cathode ray tube showed little change, and the wedge was reduced by 0.31 being smaller than 2.0. To maintain the structural strength of the panel and the uniformity of brightness of the screen, the thickness of the diagonal end of the panel (Td) and the central thickness of the panel (CFT) preferably satisfy the condition of 10 mm<(Td−CFT)<15 mm. For the same purpose mentioned above, the thickness of the horizontal axis end of the panel (Th) and the central thickness of the panel (CFT) preferably satisfy the condition of 4 mm<(Th−CFT)<8 mm. Further, the thickness of the vertical axis end of the panel (Tv) and the central thickness of the panel (CFT) preferably satisfy the condition of 8 mm<(Tv−CFT)<12 mm, in consideration of the strength of the panel and the screen brightness uniformity.

One more thing to notice from the experiment is that the natural (oscillation) frequency that determines a howling characteristic of the shadow mask was increased by 18 Hz, demonstrating much improved features that are better than the comparative example.

Table 5 shows results of transmission rates and wedges of the panel for the cathode ray tube according to an embodiment of the present invention.

TABLE 5

| | | Thickness of Panel (mm) | Transmission rate (%) | Coating Transmission rate (%) | Final Transmission rate (%) | Ratio of Transmission rates (%) | Wedge |
|---|---|---|---|---|---|---|---|
| Embodiment | Central portion | 12.5 mm | 51.2% | Not applied. | 51.2% | 59.4% | 1.9 |
| | Peripheral portion | 23.8 mm | 30.4% | Not applied. | 30.4% | | |
| Comparative Example | Central portion | 12.5 mm | 77.6% | 68% | 52.8% | 82.3% | 2.206 |
| | Peripheral portion | 27.6 mm | 63.9% | 68% | 43.5% | | |
| Difference | Central portion | 0.0 mm | −26.5% | −26.5% | | −22.9% | −0.306 |
| | Peripheral portion | −3.8 mm | −33.5% | −33.5% | | | |

As shown in Table 5, the transmission rate of the panel according to the present invention was not much different from that of the conventional panel of which the outside surface was coated, except that the peripheral thickness of the panel according to the present invention was reduced, and the ratio of the peripheral transmission rate to the central transmission rate was 59.4%, which is almost 60%. This proves that the cathode ray tube to which the present invention is applied is sufficiently competent to carry out basic performances required of the cathode ray tube. Also, the wedge of the panel according to the present invention was 1.9, which is 0.306 smaller than the wedge of the conventional panel. This ensures a uniform screen brightness and a sense of flatness.

Figure 8:
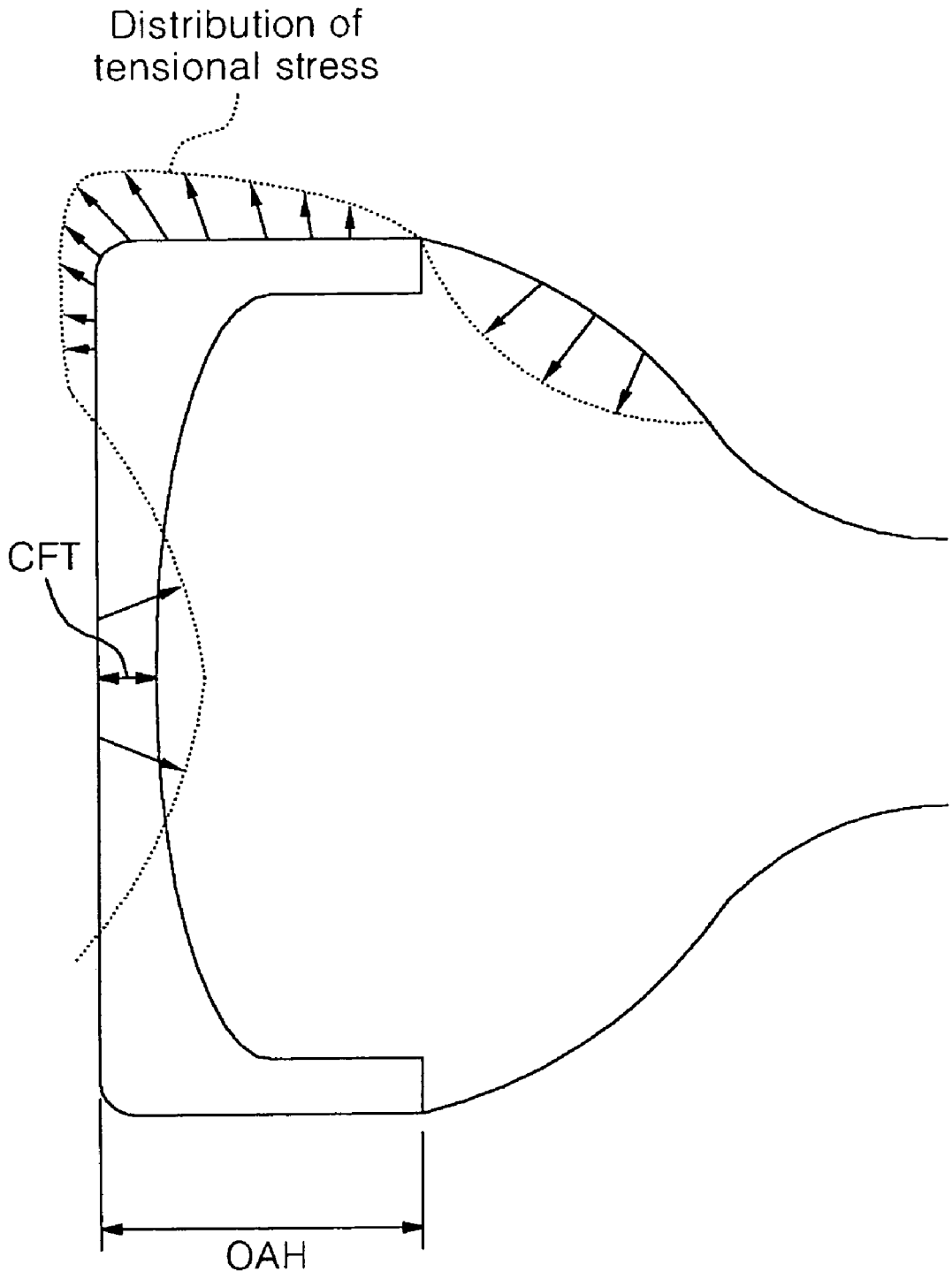
FIG. 8 is a diagram explaining the length of a skirt portion of the panel for the cathode ray tube according to the present invention.

FIG. 8 is a diagram explaining the length of skirt portion of the panel for the cathode ray tube according to the present invention.

As depicted in FIG. 8, in case of the panel having a substantially flat outside surface, the thickness of the skirt portion is relatively thinner than the edge of the effective surface. In this type of panel, given the inside the panel forms a vacuum, the panel is often under tension due to the vacuum. Particularly, the tension is intensively applied to the skirt portion that is relatively thinner than the edge of the effective surface, thereby weakening the structural strength of the skirt portion even more. This phenomenon becomes intensified as the length of the skirt portion (OAH) is reduced. Therefore, in order to minimize the tension, it is necessary to control the length of the skirt portion (OAH) of the panel at an appropriate level. Preferably, the ratio of the length of the skirt portion of the panel, OAH, to the diagonal length of the effective surface of the panel, Sd, satisfies a condition of 0.13<OAH/Sd<0.17.

When the ratio of the length of the skirt portion of the panel, OAH, to the diagonal length of the effective surface of the panel, Sd, is smaller than 0.13, tension of the skirt portion will be concentrated on the contact surface of the panel and the funnel up to 10 Mpa and more, possibly exceeding the tensional stress limit of a vacuum vessel (not larger than 10 Mpa) and giving rise to a safety problem.

On the other hand, when the ratio of the length of the skirt portion of the panel, OAH, to the diagonal length of the effective surface of the panel, Sd, is greater than 0.17, although the tension would be sufficiently reduced, the weight of the panel would be increased and the total length of the cathode ray tube would be increased. More preferably, to reduce the tension more effectively, the ratio of the length of the skirt portion of the panel, OAH, to the diagonal length of the effective surface of the panel, Sd, satisfies a condition of 0.146<OAH/Sd<0.17. For instance, in a case where OAH/Sd is 0.146, the skirt portion in a 29-inch cathode ray tube was under a tension as big as 9.7 Mpa. Also, when OAH/Sd is 0.170, 8.0 Mpa of tension was produced. In short, it is desirable to keep the ratio of the length of the skirt portion of the panel, OAH, to the diagonal length of the effective surface of the panel, Sd, in the range of 0.146<OAH/Sd<0.17, so as to minimize tension on the panel and reduce total weight and length of the cathode ray tube.

In conclusion, the cathode ray tube according to the present invention can be advantageously used in that it has improved contrast simply by lowering the transmission rate of the panel and reduced manufacturing cost without requiring a separate coating process on the panel.

Also, manufacturers may improve the sense of flatness of the screen and protect the cathode ray tube from damages by lowering the wedge. Because the panel is thinner, the total weight of the cathode ray tube may also be reduced. The shadow mask now has an improved howling characteristic. Lastly, the tension on the panel can be minimized while reducing the total length and weight of the cathode ray tube.

While the invention has been shown and described with reference to certain preferred embodiments thereof, it will be understood by those skilled in the art that various changes in form and details may be made therein without departing from the spirit and scope of the invention as defined by the appended claims.

What is claimed is:

1. A cathode ray tube with a panel, the panel comprising:

an inside surface having a designated curvature;

a central portion having a transmission rate of 45–75%;

an outside surface being substantially flat with a flatness ratio (F) satisfying a mathematical formula of $$F = \frac{Ro}{Sd \times 1.767},$$

where Ro denotes a diagonal curvature radius of the outside surface, Sd denotes a diagonal length of an effective surface of the panel, and the flatness ratio (F) of the outside surface is greater than 17; and a thickness at the central portion of the panel (CFT), a thickness of a vertical axis end (Tv), and a thickness of a diagonal end (Td), wherein CFT, Tv, and Td satisfy conditions of 1.4<Td/CFT<2.2 and 0.85<Tv/Td<1.0.

2. The cathode ray tube as claimed in claim 1, satisfying a condition of 0.13<OAH/Sd<0.17, wherein OAH denotes a length of a skirt portion of the panel and Sd denotes the diagonal length of the effective surface.

3. The cathode ray tube as claimed in claim 1, wherein a diagonal curvature radius (Rd) of the inside surface of the panel satisfies a relation of 2.0R<Rd<4.5R, wherein 1R=1.767×Sd.

4. The cathode ray tube as claimed in claim 3, wherein a vertical curvature radius of the inside surface of the panel, Rv, and a horizontal curvature radius of the inside surface of the panel, Rh, satisfy a relation of 3.0R<Rh<6.5R and 1.2R<Rv<3.5R, respectively, wherein 1R=1.767×Sd.

5. The cathode ray tube as claimed in claim 1, satisfying conditions of 10 mm<(Td−CFT)<15 mm, 4 mm<(Th−CFT)<8 mm, and 8 mm<(Tv−CFT)<12 mm, wherein Th denotes a thickness of a horizontal axis end of the panel.

6. The cathode ray tube as claimed in claim 1, wherein each thickness of the panel satisfies conditions of 1.4<Td/CFT<2.0 and 0.93<Tv/Td<1.0.

7. The cathode ray tube as claimed in claim 6, satisfying a condition of 0.146<OAH/Sd<0.17, where OAH denotes a length of a skirt portion of the panel.

8. The cathode ray tube as claimed in claim 6, wherein a diagonal curvature radius (Rd) of the inside surface of the panel satisfies a relation of 2.0R<Rd<4.5R, where 1R=1.767×Sd.

9. The cathode ray tube as claimed in claim 8, wherein a vertical curvature radius of the inside surface of the panel, Rv, and a horizontal curvature radius of the inside surface of the panel, Rh, satisfy a relation of 3.0R<Rh<6.5R and 1.2R<Rv<3.5R, respectively, where 1R=1.767×Sd.

10. The cathode ray tube as claimed in claim 6, wherein the panel satisfies conditions of 10 mm<(Td−CFT)<15 mm, 4 mm<(Th−CFT)<8 mm, and 8 mm<(Tv−CFT)<12 mm, wherein Th denotes a thickness of a horizontal axis end of the panel.

11. A cathode ray tube with a panel, the panel comprising:

a central portion having a transmission rate of 45–75%;

an outside surface being substantially flat with a flatness ratio (F) satisfying a mathematical formula of $$F = \frac{Ro}{Sd \times 1.767},$$

where Ro denotes a diagonal curvature radius of the outside surface, Sd denotes a diagonal length of an effective surface of the panel, and the flatness ratio (F) of the outside surface is greater than 17; and an inside surface having a designated curvature, in which a diagonal curvature radius of the inside surface (Rd), a vertical curvature radius of the inside surface (Rv), and a horizontal curvature radius of the inside surface (Rh), wherein Rd, Rv, and Rh satisfy conditions of 1.0<Rh/Rd<1.9 and 0.3<Rv/Rd<0.9.

12. The cathode ray tube as claimed in claim 11, wherein the panel satisfies a condition of 0.13<OAH/Sd<0.17, where OAH denotes a length of a skirt portion of the panel.

13. The cathode ray tube as claimed in claim 11, wherein Rd satisfies a relation of 2.0R<Rd<4.5R, where 1R=1.767×Sd.

14. The cathode ray tube as claimed in claim 13, wherein Rv and Rh satisfy a relation of 3.0R<Rh<6.5R and 1.2R<Rv<3.5R, respectively, where 1R=1.767×Sd.

15. The cathode ray tube as claimed in claim 11, wherein the panel satisfies conditions of 10 mm<(Td−CFT)<15 mm, 4 mm<(Th−CFT)<8 mm, and 8 mm<(Tv−CFT)<12 mm, wherein CFT denotes a thickness of a central portion of the panel; Tv denotes a thickness of a vertical axis end of the panel; Td denotes a thickness of a diagonal end of the panel; and Th denotes a thickness of a horizontal axis end of the panel.

16. The cathode ray tube as claimed in claim 11, wherein the radii Rd, Rv, and Rh satisfy a relation of Rv<Rd<Rh.

17. The cathode ray tube as claimed in claim 11, wherein the radii Rh, Rd, and Rv of the panel satisfy the conditions of 1.0<Rh/Rd<1.3 and 0.3<Rv/Rd<0.9.

18. The cathode ray tube as claimed in claim 17, wherein the panel satisfies a condition of 0.146<OAH/Sd<0.17, wherein OAH denotes a length of a skirt portion of the panel.

19. The cathode ray tube as claimed in claim 17, wherein the radius Rd satisfies a relation of 2.0R<Rd<4.5R, wherein 1R=1.767×Sd.

20. The cathode ray tube as claimed in claim 19, wherein Rh and Rv satisfy a relation of 3.0R<Rh<6.5R and 1.2R<Rv<3.5R, respectively, wherein 1R=1.767×Sd.

21. The cathode ray tube as claimed in claims 17, wherein the panel satisfies conditions of 10 mm<(Td−CFT)<15 mm, 4 mm<(Th−CFT)<8 mm, and 8 mm<(Tv−CFT)<12 mm, wherein CFT denotes a thickness of a central portion of the panel; Tv denotes a thickness of a vertical axis end of the panel; Td denotes a thickness of a diagonal end of the panel; and Th denotes a thickness of a horizontal axis end of the panel.

22. The cathode ray tube as claimed in claim 17, wherein the radii Rd, Rv, and Rh satisfy a relation of Rv<Rd<Rh.

* * * * *